US009868264B2

(12) United States Patent
Fahrenbach

(10) Patent No.: US 9,868,264 B2
(45) Date of Patent: Jan. 16, 2018

(54) PRESS WITH TWO DRIVE MOTORS

(71) Applicant: Juergen Fahrenbach, Aichelberg (DE)

(72) Inventor: Juergen Fahrenbach, Aichelberg (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 1011 days.

(21) Appl. No.: 13/837,831

(22) Filed: Mar. 15, 2013

(65) Prior Publication Data

US 2013/0247781 A1 Sep. 26, 2013

(30) Foreign Application Priority Data

Mar. 23, 2012 (DE) ..... 10 2012 102 522

(51) Int. Cl.

| | |
|---|---|
| ***B30B 15/14*** | (2006.01) |
| ***B30B 1/26*** | (2006.01) |
| ***B30B 1/14*** | (2006.01) |
| ***B30B 1/06*** | (2006.01) |

(52) U.S. Cl.

CPC ..... *B30B 15/148* (2013.01); *B30B 1/06* (2013.01); *B30B 1/14* (2013.01); *B30B 1/266* (2013.01); *B30B 1/268* (2013.01)

(58) Field of Classification Search

CPC ..... B30B 15/04; B30B 1/266; B30B 15/047; B30B 15/14; B30B 15/148; B30B 15/18; B30B 1/02; B30B 1/06; B30B 1/26; B30B 1/268; B30B 1/14

USPC ..... 100/43, 48, 280, 282, 283, 292, 35

See application file for complete search history.

(56) References Cited

U.S. PATENT DOCUMENTS

| | | | | |
|---|---|---|---|---|
| 6,200,122 | B1 * | 3/2001 | Chun | B29C 51/38 100/286 |
| 7,102,316 | B2 * | 9/2006 | Beyer | B30B 1/266 100/144 |
| 2004/0003729 | A1 * | 1/2004 | Aoshima | B30B 15/14 100/35 |
| 2005/0145117 | A1 * | 7/2005 | Du | B30B 1/14 100/281 |
| 2005/0257697 | A1 * | 11/2005 | Futamura | B30B 1/18 100/46 |

(Continued)

FOREIGN PATENT DOCUMENTS

| | | |
|---|---|---|
| DE | 198 10 406 A1 | 9/1999 |
| DE | 10 2005 001 878 B3 | 8/2006 |

(Continued)

*Primary Examiner* — Jimmy T Nguyen
(74) *Attorney, Agent, or Firm* — R. S. Lombard

(57) ABSTRACT

A press with a press drive for moving a plunger in stroke direction (H). The press drive comprises two electric drive motors which are controllable independently of each other. The two drive motors are connected to the plunger via a drive unit. A control arrangement is provided for controlling the two drive motors. The control arrangement includes a characteristic plunger curve (K) which determines the plunger positions and/or the plunger movement and/or the plunger force dependent on time or dependent on a so-called virtual press angle. In addition, the control arrangement includes an additional condition which is independent of the characteristic plunger curve (K). Via the additional condition the operation of the press drive, for example, in an optimum operating range and/or a low-wear lubrication state of the support bearings of the drive unit can be ensured.

11 Claims, 6 Drawing Sheets

(56) References Cited

U.S. PATENT DOCUMENTS

| | | | | |
|---|---|---|---|---|
| 2010/0282098 | A1* | 11/2010 | Yamasaki | B30B 1/106<br>100/35 |
| 2010/0320856 | A1* | 12/2010 | Lauke | B21J 9/18<br>310/80 |
| 2011/0290126 | A1* | 12/2011 | Ito | B30B 15/148<br>100/280 |

FOREIGN PATENT DOCUMENTS

| | | | |
|---|---|---|---|
| DE | 10 2006 050 298 | A1 | 4/2008 |
| DE | 10 2006 056 520 | A1 | 6/2008 |
| EP | 0 941 832 | A1 | 9/1999 |
| JP | 2004 017098 | A | 1/2006 |
| WO | WO 2011/144415 | A2 | 11/2011 |

* cited by examiner

PRESS WITH TWO DRIVE MOTORS

CROSS-REFERENCE TO RELATED APPLICATION

This application claims the priority benefits of German Application No. 10 2012 102 522.3 filed Mar. 23, 2012.

BACKGROUND OF THE INVENTION

The invention resides in a press with a plunger which is supported so as to be movably guided in a stroke direction and which can be moved by means of a press drive in the stroke direction for performing a plunger stroke. The press drive includes a first drive motor and a second drive motor. The two drive motors are connected to the plunger via a drive unit. A control arrangement associated with the press controls the two drive motors.

Presses with several drive motors which are connected to the press plunger by way of a drive unit are known in various configurations. DE 10 2006 056 520 A1, for example, describes a press with curve correction. Therein, in addition to the main press drive, an adjustment drive is provided for varying the characteristic plunger curve, which determines the plunger force and/or the plunger movement. In this way, in particular, a deformation method is to be provided wherein the tool mounted to the plunger comes in contact with the workpiece at a low speed close to zero.

DE 10 2005 001 878 63 discloses a servo press with an elbow lever drive. The elbow lever drive is operated by a servomotor. Furthermore, an form of a linear drive. The force moving the plunger in an upper stroke range is generated by the additional drive, when the elbow drive leaves its control range and enters a neutral range.

It is the object of the invention to provide a press with a compact press drive which presents a flexible use of the press.

SUMMARY OF THE INVENTION

The object is achieved in accordance with the invention by a press and method as defined in the claims.

In accordance with the invention, the plunger and the two drive motors are interconnected or, respectively, coupled via the drive unit of the press drive. The drive motors are preferably in the form of servomotors. They may, for example, be transversal flux machines. The plunger stroke which can be executed via each of the two drive motors and the associated drive unit is preferably equally large. In other words, the same plunger stroke can be performed by means of the first as well as the second drive motor.

The two drive motors are controlled by a control arrangement. The control arrangement includes, stored therein, a characteristic plunger curve. Via the characteristic plunger curve, the plunger movement and/or plunger force is predetermined. The characteristic plunger curve consequently can determine the acceleration and/or speed and/or position of the plunger and/or force applied by the plunger to a workpiece. Furthermore, the control arrangement is subject to an additional condition which is independent of the plunger position and/or the plunger movement and/or the plunger force. Via the, at least one additional condition, desired press states can be adjusted and/or undesired press states can be excluded. Wherein, at the same time, the predetermined characteristic plunger curve is maintained.

In a preferred exemplary embodiment, the additional condition is met when the bearings of the drive are sufficiently lubricated. This is, in particular, the case when in each bearing of the drive unit has a sufficient relative movement of the drive unit components supported on one another. For example, a sufficient relative movement of the two drive unit parts of a bearing is present, if the relative speed of the two drive unit parts corresponds at least to a predetermined threshold value. Then, it is ensured that a dynamic lubrication has been reached and a sufficient lubricant film is present between the two drive unit parts. In this way, wear of the two drive unit parts is reduced and the life of the press is increased.

The threshold value for the relative speed of the two drive unit components of a bearing can be predetermined depending on certain parameters. It may depend, for example, on the bearing force and/or the use of the bearing clearance between the two drive unit components and/or the viscosity of the lubricant.

In the press, according to the invention, the plunger can, for example, be stopped when in a deformation process or a machining process of the workpiece, a certain plunger force is to be applied to the workpiece for a predetermined period, or when two molding tool parts are to be pressed against one another while the plunger is stopped. This condition can be controlled by the control arrangement. During such a plunger stop, both drive motors are still driven so that movement in the bearings is maintained and a sufficient lubricant film is formed in the bearings also when the plunger is stopped. The plunger may be stopped in any position of the plunger along the plunger stroke while movement in the bearings of the drive unit is maintained.

In a preferred exemplary embodiment the additional condition is met if one of the two drive motors is operated in a predetermined state of operation. Preferably the two drive motors are of different design. The first drive motor has its optimum efficiency at a higher torque than the second drive motor. The second drive motor has its optimum efficiency at a higher speed than the first drive motor. In this way, the two drive motors can be controlled by the control unit in such a way that for a predetermined characteristic plunger curve, the efficiency of the one and preferably both drive motors is optimized so that overall the lowest possible energy loss occurs.

A preferred embodiment of the press comprises a drive unit which includes a first eccentric connected to the first drive motor and a second eccentric connected to the second drive motor. Preferably the two drive motors are arranged along a common axis whereby a compact and space saving set-up is achieved. For example, both eccentrics may be supported on a common shaft on the press frame.

The control arrangement can control the two drive motors in such a way that the relative position between the two eccentrics which is characterized by a relative angle is fixed or changeable. In other words, the two eccentrics can be rotated relative to each other about their common axis or they may have always the same relative position during operation.

The drive unit includes preferably a main connecting rod which is connected to the first eccentric, a control connecting rod which is connected to the second eccentric and in particular, a multi-arm lever which is connected, in each case via a bearing to the main connecting rod, the control connecting rod and the plunger. The drive unit can be realized with little space requirements and provides for sufficiently large plunger stroke and a sufficient plunger force.

In an advantageous exemplary embodiment, the force provided by the first drive motor or, respectively, the first eccentric in stroke direction to the plunger is greater than the force provided to the eccentric by the second drive motor or respectively the second eccentric. The maximum force exerted by the plunger in stroke direction is provided, for example, only with 10 to 20% by the second drive motor and/or the second eccentric. The largest part of the plunger force is therefore generated by the first drive motor which is therefore so designed that it has a high efficiency at low speeds and high torques.

The control arrangement may have a wireless interface. Via the wireless interface control data can be sent and/or received. The control arrangement can in this way communicate wirelessly with an external apparatus, for example, a mobile telephone or a portable computer. This has the advantage that the man-machine interface at the press may be of very simple design and, for example, a monitor attached to the press can be omitted. Via the wireless interface actual press settings can be detected and/or changed. The wireless interface is preferably formed by a Bluetooth-interface so that the external apparatus does not require particular hardware equipment. The communication between the external apparatus and the control arrangement via the wireless interface may also be coded. The access to the control arrangement via the wireless interface may be password protected in order to avoid unauthorized access to the control arrangement. Preferably, the transmission capability of the wireless interface of the control arrangement is limited to a distance of several meters, for example, two to five meters, so that an unauthorized access to the control arrangement is made difficult or is prevented also in this way.

In a further advantageous embodiment, the press drive may include a third drive motor which is connected to the plunger by way of the drive unit. The third drive motor is also a servomotor which is preferably connected to the plunger via a third eccentric. The third press drive compensates, at least, partially for an unsymmetrical plunger force. By a non-symmetrical loading, the plunger may tilt about an axis at a right angle to the stroke direction whereby, the plunger guide structure is stressed transverse to the stroke direction resulting in increased wear thereof. The tilt movement can be at least redirected by an appropriate control of the third press drive.

BRIEF DESCRIPTION OF THE DRAWINGS

Advantageous embodiments of the invention are defined in the dependent claims and in the description. The description is limited to essential features of the invention with reference to the accompanying drawings. Below exemplary embodiments of the invention will be described in greater detail on the basis of the enclosed drawings.

It is shown in.

DETAILED DESCRIPTION OF THE INVENTION

Figure 1:
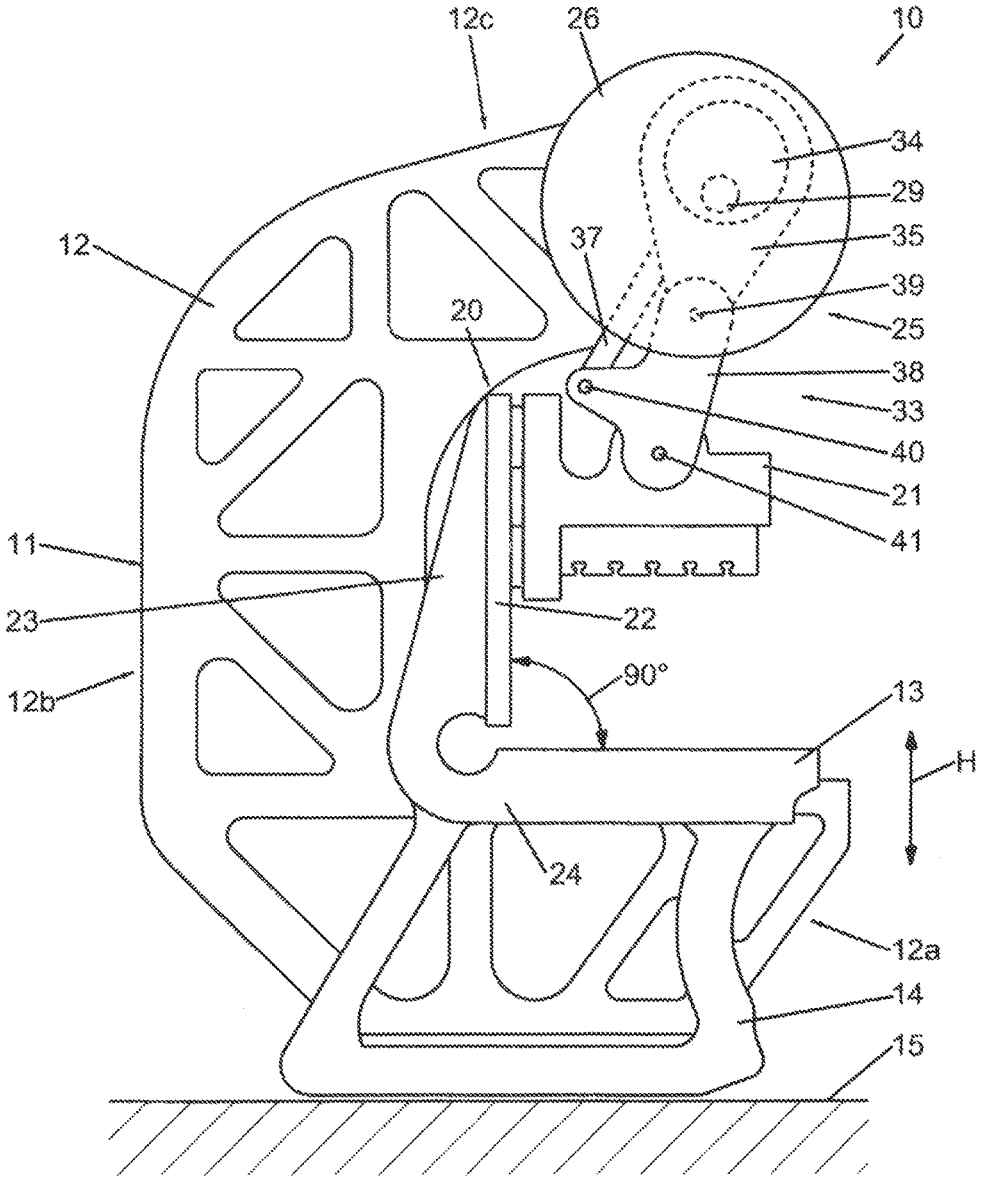
FIG. 1 a schematic side view of a press with a C-shaped frame.
Figure 2:
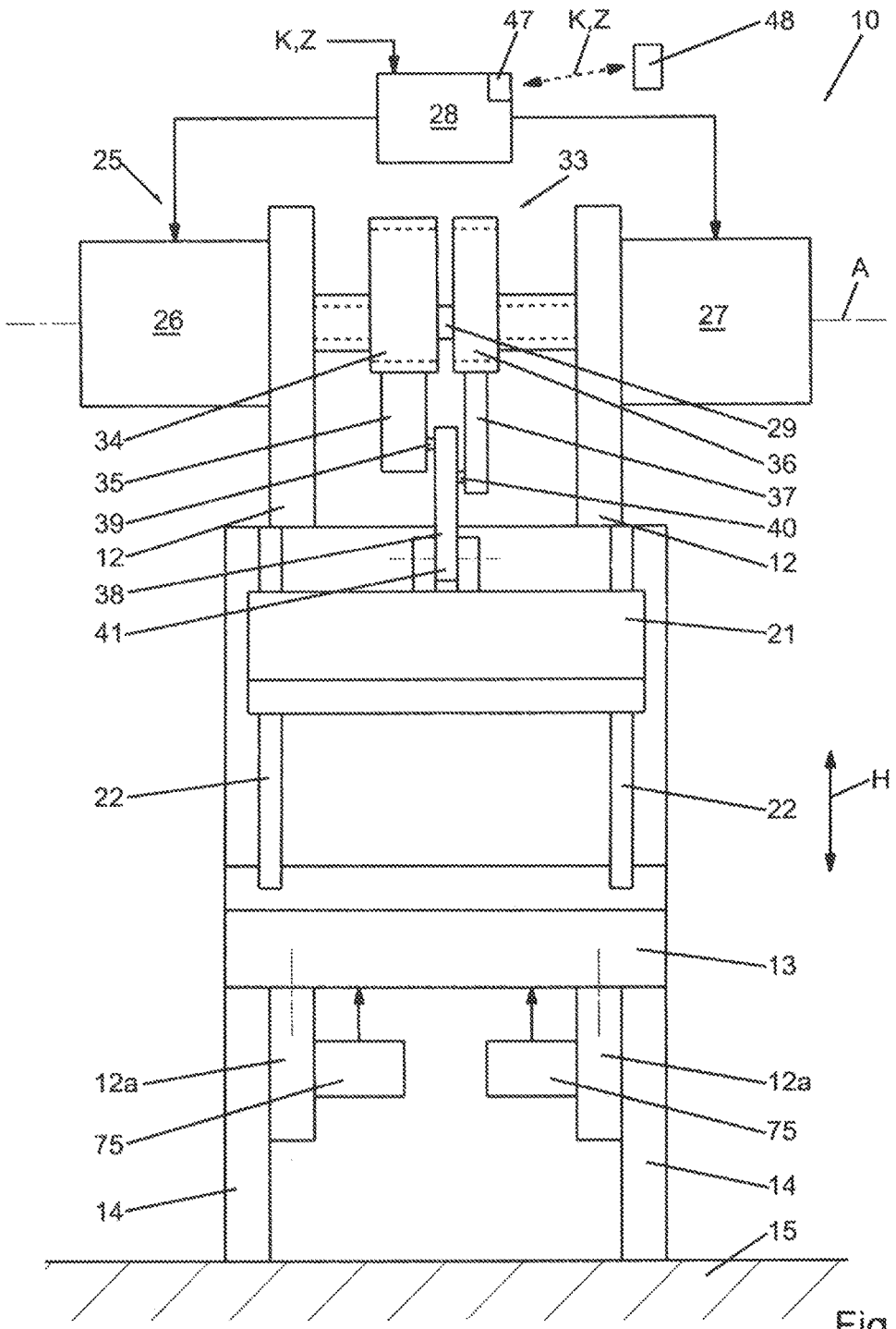
FIG. 2 schematically a front view of the press as shown in FIG. 1.

FIGS. 1 and 2 show a press 10 with a C-shaped press frame 11. In the exemplary embodiment, the press frame 11 comprises two identically contoured frame elements 12 which are arranged in spaced relationship. The two frame elements 12 are hoop- or C-shaped.

The press 10 further includes a press table 13 disposed on a socket 14. The press 10 extends around the socket 14 and is supported on a base 15 or is connected to the base 15, for example, bolted thereto. The press frame 12 is connected to the press table 13 and/or the socket 14. In the exemplary embodiment, the socket 14 is not supporting the press on the base 15.

The press further includes a guide arrangement 20 which guides a plunger 21 of the press 10 in a stroke direction H. To this end, the guide arrangement 20 may have one or several slide support tracks 22. The tracks 22 may be attached to a support structure 23 which extends in the stroke direction or they may be formed integrally with the support structure 23. In the exemplary embodiment described herein, the support structure 23 and the press table 13 form an angled element 24 which is manufactured, for example, of the same material as a single piece without joint. In this way, an accurate right-angled orientation of the press table 13 and the guide arrangement 20 for guiding the plunger can be ensured.

The press frame 12 is not connected to the guide arrangement 20 and in particular not to the support structure 23. The orientation of the guide arrangement 20 with respect to the press table 13 is therefore not detrimentally affected by a resilient deformation of the C-shaped press frame 11.

The press frame 11 or, respectively, the frame elements 12 have a mounting section 12*a*, adjacent thereto an intermediate section 12*b* and a holding section 12*c* which is disposed adjacent the intermediate section 12*b* and extends over the press table 13. The holding section 12*c* supports a press drive 25 on the press frame 11 above the press table 13.

The press drive comprises a first drive motor 26 and a second drive motor 27. The two drive motors 26, 27 are electric servomotors or torque motors. Preferably, the two electric motors 26, 27 are in the form of transversal flux motors. The press drive and, in particular, the two drive motors 26, 27 are controlled by a control arrangement 28 of the press 10.

The two drive motors are supported on the press frame 11 along a common axis A. To this end, for example, as support shaft 29 extending along the axis A may be supported by the two frame elements 12.

The press drive 25, in addition, includes a drive unit 33 which forms the connection between the two drive motors 26, 27 and the plunger 21. The drive unit 33 comprises, in the exemplary embodiment, a first eccentric 34 which is driven by the first drive motor 26 eccentrically about the axis A and which is connected to a main connecting rod 35. A second eccentric 36 disposed eccentrically along the axis A is driven by the drive motor 27 and supports a control connecting rod 37. The drive unit 33 comprises further a multi-arm lever 38 which is connected, via a first pivot 39 to the main connecting rod 35, via a second pivot 40 to the control connecting rod 37, and via a third pivot 41 to the plunger 21. The three pivots 39, 40, 41 are in the form of friction bearings. At each pivot 39, 40, 41, two drive components G1, G2 are movably, for example, rotatably or respectively pivotably, supported with respect to each other. The first drive component G1 is formed at the first pivot 39 by the main connecting rod 35, at the second pivot 40 by the control connecting rod 37, and at the third pivot 41 by the plunger 21. The second drive component G2 is formed in each case by the lever 38. The two drive components G1, G2 are supported pivotally relative to each other.

Each pivot 39, 40, 41 of the drive unit 33 is lubricated by a lubricant. As long as the two drive components G1, G2 of an associated pivot 39, 40, 41 move relative to one another fast enough, a dynamic lubrication and a lubricant film of sufficient thickness is maintained between the two drive components G1, G2. This lubricant film ensures that the wear at each pivot 39, 40, 41 is small since the lubricant film thickness is so selected that it exceeds that of the dirt particles contained in the lubricant.

Figure 6:
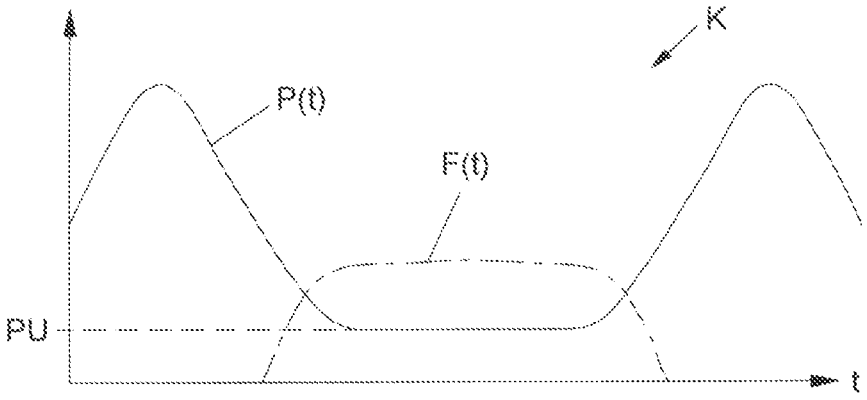
FIG. 6 an exemplary representation of the force applied by the plunger and the plunger position over the time t.
Figure 7:
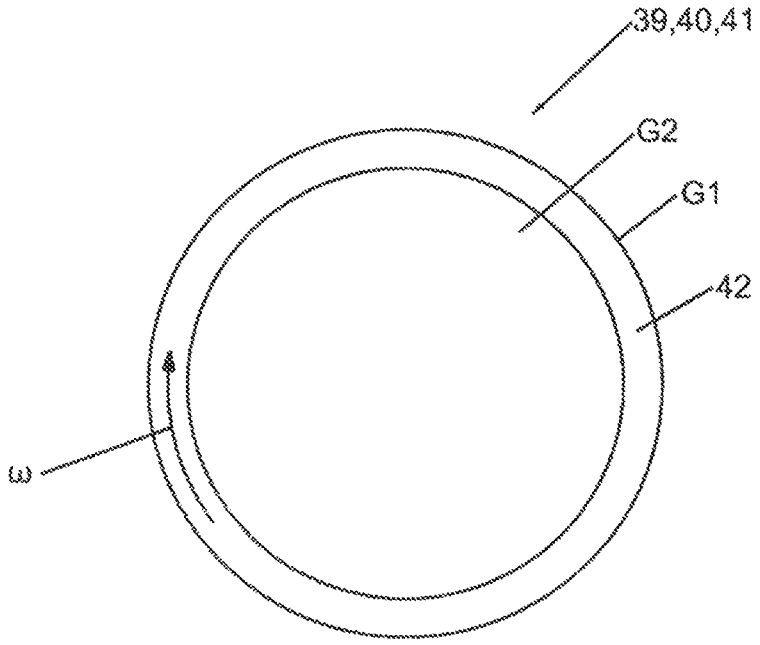
FIG. 7 shows the movement of a multi-arm lever of a drive unit of the press drive.

In order to maintain such a lubricant film in the pivots 39, 40, 41 of the drive unit 33 so far, a corresponding plunger movement was required. In particular, stand-still phases in which at the same time a plunger force has to be applied by the plunger, for example, in the lower reversal point are problematic as far as the bearing load is concerned. But in many working procedures, it is desirable to stop the plunger 21, in particular, in its lower reversal position for a certain period while applying a plunger force F as it is indicated by the characteristic plunger curve K shown schematically in FIG. 6. The characteristic plunger curve is indicated in FIG. 6 by the time-dependent plunger force line F and the plunger position line P. The characteristic plunger curve K, as shown in FIG. 6, is only exemplary and is variable in a wide range. The shown characteristic plunger line K is only intended to explain the principle of the present invention.

The characteristic plunger line K is supplied to the control arrangement 28 as control template. The control arrangement 28 therefore controls the plunger position P and/or the plunger force F in accordance with the characteristic plunger curve K.

Furthermore, an additional condition Z is supplied to the control arrangement 28. The additional condition is independent of the characteristic plunger curve and, consequently, independent of the plunger position and the plunger movement—also of the plunger speed or the plunger acceleration or other time-dependent deviations of the plunger position P—as well as independent of the plunger force F which is exerted by the plunger 21 on a press tool or the workpiece. By way of the additional condition desired, press conditions are set and/or undesirable press conditions are excluded.

In an exemplary embodiment, as described herein, an additional condition Z is complied with if in each pivot bearing 39, 40, 41 of the drive unit 33 sufficient lubrication is provided between the drive components G1 or respectively G2 which are pivotally interconnected. In order to ensure sufficient lubrication, the relative speed $\omega$ between the two drive components G1, G2 must reach a threshold relative speed value $\omega g$ or exceed this value. Consequently, the first additional condition Z is: $\omega \geq \omega g$. As a result, the additional condition requires a continuous relative movement in the pivot bearings 39, 40, 41 also when the plunger is stopped at its lower reversal position PU for a certain period and, at the same time a plunger force F is to be provided as it is indicated by the characteristic plunger curve K in FIG. 6.

Figure 3:
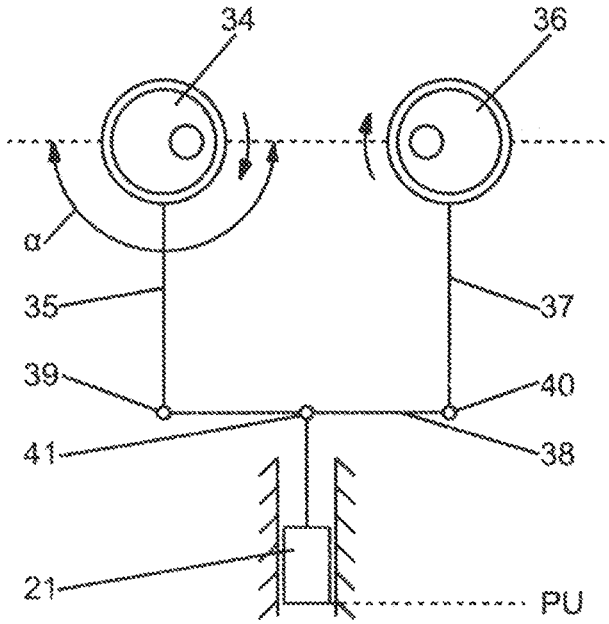
FIGS. 3 and 4 schematic representations of the cooperation of the two drive motors of an embodiment of the press drive.
Figure 4:
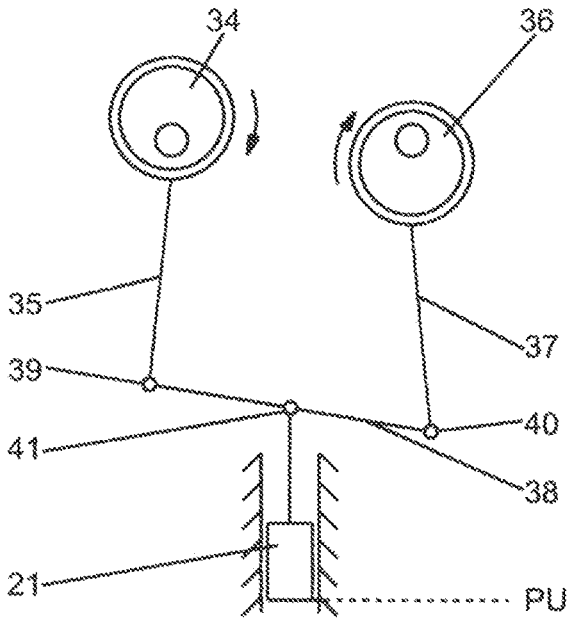

The FIGS. 3 and 4 show schematically how the control arrangement 28 controls the two drive motors 26, 27 and, respectively, the two eccentrics 34, 36 in order to maintain the lubrication of the pivot bearings 39, 40, 41 and to follow at the same time the demand of the characteristic plunger curve K. Assuming that the plunger 21 is at rest at its lower reversal point PU, the two eccentrics 34, 36 are controlled so as to move in an opposite sense so as to maintain the plunger position P at the lower reversal point PU. It is assumed in FIGS. 3 and 4, for example, that between the first eccentric 34 and the second eccentric 36 a relative angle $\alpha$ can be maintained during operation of the press 10 by a corresponding control of the two drive motors 26, 27 or it can be variable. This depends on the characteristic plunger curve K and the additional condition Z.

In order to maintain the plunger position P in the lower reversal point PU constant, the first eccentric 34 moves the main connecting rod 35 in stroke direction H away from the press table 13 while the second eccentric 36 moves the control connecting rod 37 in stroke direction H toward the press table 13 or vice versa. As apparent from the schematic representation according to FIGS. 3 and 4 at each bearing 39, 40, 41 the two drive parts G1 G2 joined there are thereby rotated relative to each other without changing the position P of the plunger 21. As a result, a lubrication of the bearings 39, 40, 41 is ensured, so that the press 10 can be operated with little wear. At the same time, a large band width of characteristic plunger curves K can be realized without detrimentally affecting the life of the press 10.

The threshold value $\omega g$ for the relative speed w between the two drive components G1, G2 at a bearing 39, 40, 41 may be provided in a parameter-dependent form. The threshold value $\omega g$ may depend in particular on the bearing force effective between the drive components G1 and G2 of the respective bearing 39, 40, 41 and/or the size of a bearing gap 42, that is the distance between the two drive parts G1 G2 and/or the viscosity of the lubricant in the bearing gap 42. The viscosity may change with the temperature of the lubricant. As a result also, the threshold value $\omega g$ may be temperature dependent and may be changed during operation of the press.

Figure 5:
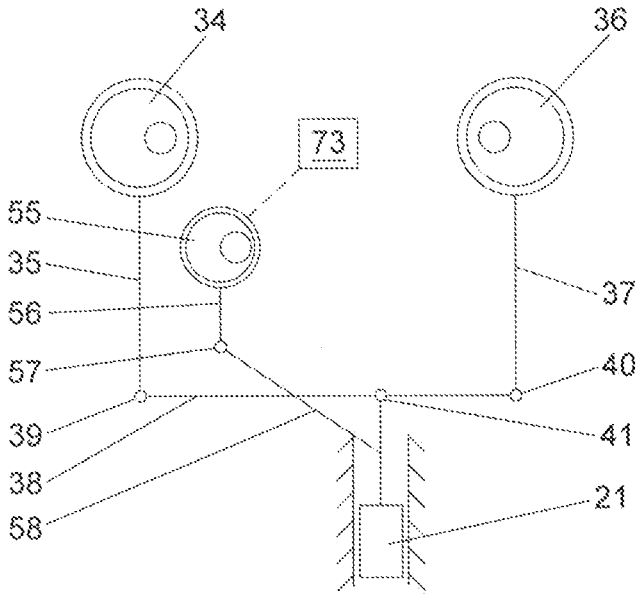
FIG. 5 a schematic representation of a modified embodiment of the press drive with three drive motors.
Figure 9:
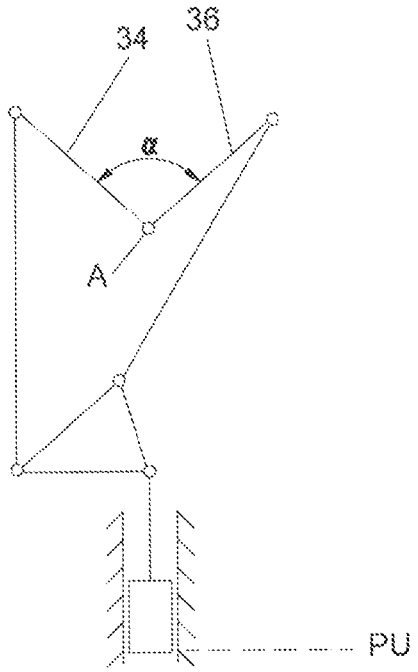
FIG. 9 is a schematic representation of the cooperation of the two drive motors of another embodiment of the press drive; and, FIG. 10 shows an adjustable series of curves for the stroke of the plunger depending on the rotational position of the two drive motors and a relative angle $\alpha$.

FIGS. 3 to 5 show the eccentrics 34, 36 disposed in spaced relationships on parallel axis of rotation. This arrangement may also be provided in the press according to FIGS. 1 and 2 in a modification of the shown embodiment. FIG. 9 shows an arrangement of the two drive motors or, respectively, the eccentrics 34, 36 on a common axis A. The functioning is in principle the same for both variants. Because of the different special arrangement the kinematics differs in the two embodiments.

Figure 10:
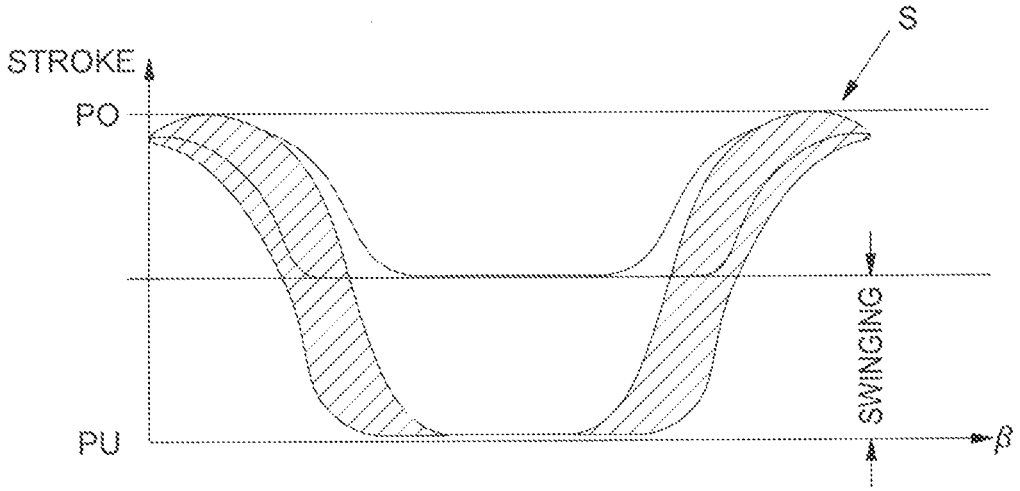

By changing the relative angle $\alpha$ between the two eccentrics 34, 36 the characteristic press curve K can be changed. The relative angle $\alpha$ remains preferably unchanged during press operation, but for establishing a desired characteristic curve K it can be changed within the curve range S as shown in FIG. 10. In FIG. 10, the stroke or respectively, the position of the plunger 21 depends on the rotational position $\beta$ of the two eccentrics 34, 36 around the axis A. Also the position of the lower reversal point PU of the plunger movement can be adjusted. The plunger may also be driven so as to pivot around its lower reversal point PU. With this pivot drive, the two eccentric 34, 36 do not rotate fully around their axis of rotation, but pivot back and forth within an angular range.

As schematically shown in FIG. 2, the control arrangement may include a wireless interface 47. Via this wireless interface 47, for example, control data such as the characteristic plunger curve and/or the plunger force can be provided or changed. Via the wireless interface 47, the control arrangement 28 can communicate with an external device 48, preferably bi-directionally. Via the external device 48 also, actual operating or control data of the press 10 is read out or indicated to an operator. As external device 48, preferably portable computers, such as notebooks, laptops or tablet computers or even mobile telephones may be used. In order to avoid the need for such an external device 48 to require special equipment, preferably a standard interface, such as a Bluetooth interface is used as an interface.

The parts of the plunger force F which can be provided by the two drive motors 26, 27 are different in the exemplary embodiment. With the maximum plunger force Fmax applied by the plunger 21, the part supplied to the plunger 21 by the drive motor 26 and the drive unit 33 is 80 to 90% of the maximum plunger force Fmax. Accordingly, the part which is supplied by the second drive motor 27 via the drive unit 33 is 10 to 20% of the maximum plunger force Fmax.

The press drive 25 may also be adjusted so as to improve the energy efficiency of the press. Depending on whether a high plunger force F or a fast plunger movement is required, the two drive motors 26, 27 can be timed by the control arrangement 28 so as to optimize the overall efficiency of the press drive 25. To achieve this, for example, an additional and/or an alternative condition Z in the form of a torque or a torque range and/or a rotational speed or speed range may be provided for each of the two drive motors 26, 27. It is also possible to maximize the overall efficiency of the two drive motors 26, 27 and determine herefrom the speed and the torque for each of the two drive motors 26, 27.

In this way at least one, but preferably both drive motors 26, 27 can be operated with an additional condition Z under operating conditions which provide for a high efficiency, whereby the need for electric energy for the press drive 25 for generating the required mechanical energy is minimized.

In this connection, it is possible to construct the first drive motor 26 in such a way that its optimum efficiency is at a higher torque than that of the second drive motor 27 whose optimum efficiency may occur at a higher speed than that of the first drive motor 26.

FIG. 5 shows a modified exemplary embodiment of the press 10. Different from the press embodiments described so far the press drive 25 includes a third drive motor 73 which drives a third eccentric 55. The third eccentric 55 is provided with a compensation connecting rod 56 which is connected to a compensation lever 58 by a fourth support bearing 57. The compensation lever 58 acts directly or indirectly on the plunger 21.

The purpose of the third drive motor is to compensate for an off-center arrangement. An off-center arrangement is to be understood as an unbalanced loading of the plunger 21 which causes the plunger to be subjected to a tilting moment about its tilt axis extending at a right angle to the stroke direction H. By the compensation lever 58, such a tilt moment can be at least partially compensated for. The force on the plunger 21 generated by the third drive motor must be introduced to the plunger 21 at a distance from the pivot axis in order to be able to compensate for the tilt moment.

Figure 8:
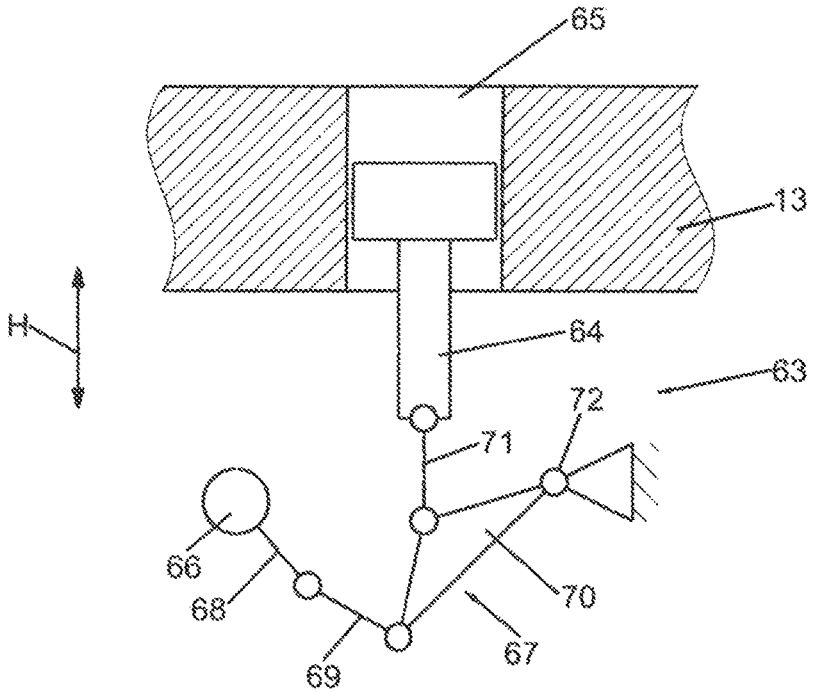
FIG. 8 shows schematically an ejector of the press according to FIGS. 1 and 2.

The press table 13 may furthermore be provided with an ejector 63 as it is shown schematically in FIG. 8. The ejector 63 has an ejection piston 64 which is supported in a cavity 65 of the press table 13 and is supported therein so as to be movable in the stroke direction H. An ejection drive 66 in the form of an eccentric drive is connected to the ejection piston 64 via an ejection drive 67. The ejection eccentric 68 of the ejection drive 66 is pivotally connected via a first rod 69 to an ejection lever 70 which is pivotally linked to the ejection piston 64 by via a second rod 71. The ejection lever 70 is pivotally supported via a pivot bearing 72 on the press frame 11, the press table 13 or the socket 14. The support locations at the ejection lever 70 and the length of the rods 69, 71 determine the kinematics of the ejection drive 67. By the ejection drive 67, the rotational movement of the ejection eccentric 68 is converted to a back and forth movement of the ejection piston 64. The force of the ejection lever 70 in the stroke direction H is variable. The ejection force provided by the ejection piston 64 is largest at the beginning of its stroke movement in the stroke direction toward the plunger 21 and subsequently becomes smaller.

In a further modified embodiment, the press 10 may additionally include an adjustment arrangement 75 as it is shown schematically in FIG. 2. By means of the adjustment arrangement 75, the position of the press table in stroke direction relative to the press table can be adjusted. The press 10 can in this way be adapted to, for example, to tools and/or workpieces of different sizes.

The present invention resides in a press 10 with a press drive 25 for moving a plunger 21 in stroke direction H. The press drive 25 includes two drive motors 26, 27 which can be controlled independently of each other. The two drive motors are connected to a plunger 21 via a drive unit 33. A control arrangement 28 is provided for controlling the two drive motors 26, 27. The control arrangement 28 is supplied with a characteristic plunger curve K which determines the plunger position P and/or the plunger movement and/or the plunger force F depending on time t as with respect to a so-called virtual press angle. Furthermore, an additional condition is provided to the control arrangement 28 which is independent of the characteristic plunger curve K, and consequently independent of the plunger position P, the plunger movement and the plunger force F. The two drive motors 26, 27 are so controlled that the additional condition is satisfied and the plunger 21 follows the characteristic plunger curve K. By way of the additional condition Z, for example, the operation of the press drive 25 in an optimal operating range and or a low-wear lubrication state of the support bearings 39, 40, 41 of the drive unit 33 can be ensured.

LISTING OF REFERENCE NUMERALS

10 press
11 press frame
12 frame element
12*a* mounting section
12*b* intermediate section
12*c* holding section
13 press table
14 socket
15 base
20 guide arrangement
21 plunger
22 slide support track
23 support structure
24 angled element
25 press drive
26 first drive motor
27 second drive motor
28 control arrangement
29 support shaft

33 drive unit
34 first eccentric
35 main connecting rod
36 second eccentric
37 control connecting rod
38 lever
39 first pivot
40 second pivot
41 third pivot
42 bearing gap
47 interface
48 external device
55 third eccentric
56 compensation connecting rod
57 fourth support bearing
58 compensation lever
63 ejector
64 ejection piston
65 cavity
66 ejection drive
67 ejection eccentric
68 ejection eccentric
69 first rod
70 ejection lever
71 second rod
72 pivot bearing
73 third drive motor
75 adjustment arrangement
α relative angle
β rotational position
ω relative speed
A axis
G1 first drive component
G2 second drive component
H stroke direction
K characteristic press curve
S curve range

What is claimed is:

1. Press (10) comprising:

a plunger (21) which is movable by a press drive (25) in a stroke direction H;

wherein the press drive (25) includes a first drive motor (26) and a second drive motor (27) which are connected to the plunger (21) via a drive unit (33);

wherein the drive unit (33) includes a first eccentric (34) connected to the first drive motor (26) and a second eccentric (36) connected to the second drive motor (27);

wherein the first eccentric (34) operatively connected to a main connecting rod (35) and the second eccentric (36) is operatively connected to a control connecting rod (37);

wherein drive unit (33) further comprises a multi-arm lever (38) operatively connected via a first pivot bearing (39) to the main connecting rod (35) and via a second pivot bearing (40) to the control connecting rod (37) and via a third pivot bearing (41) to the plunger (21);

a control arrangement (28) for controlling at least the first drive motor (26) and the second drive motor (27) for moving the plunger (21) and applying a plunger force thereto in accordance with a predetermined characteristic plunger curve (K);

wherein the two drive motors (26, 27) are controlled in accordance with the characteristic plunger curve (K) in such a way that at least one additional condition (Z) which is independent of a change of plunger position (P) as predetermined by the characteristic plunger curve (K) and/or the plunger force (F) is fulfilled; and, wherein each of the first pivot bearing (39) and the second pivot bearing (40) and the third pivot bearing (41) include in each case two drive components (G1, G2) supported to be movable relative to each other and wherein a first additional condition of the at least one additional condition (Z) is fulfilled when the two drive components (G1, G2) in each of the first pivot bearing (39) and the second pivot bearing (40) and the third pivot bearing (41) have a predetermined relative movement between the two drive components (G1, G2) for maintaining a predetermined minimum thickness of a lubricant film therebetween independent of whether the position (P) of the plunger (21) changes or whether the plunger (21) is moving or is stopped.

2. Press (10) according to claim 1, wherein the predetermined relative movement is present when a relative speed (co) between the two drive components (G1, G2) of each of the first pivot bearing (39) and the second pivot bearing (40) and the third pivot bearing (41) corresponds at least to a predetermined threshold relative speed value (ωg).

3. Press (10) according to claim 1, wherein a second additional condition of the at least one additional condition (Z) is fulfilled when one of the two drive motors (26, 27) is operated in a predetermined operating state.

4. Press (10) according to claim 1, wherein the first eccentric (34) and the second eccentric (36) are arranged along a common axis (A).

5. Press (10) according to claim 4, wherein a relative angle (α) describing a relative position between the first eccentric (34) and the second eccentric (36) is predetermined fixed or variable.

6. Press (10) according to claim 1, wherein the force provided to the plunger (21) by the first drive motor (26) and/or the first eccentric (34) is greater than the force provided by the second drive motor (27) and/or the second eccentric (36).

7. Press (10) according to claim 1, wherein the control arrangement (28) includes a wireless interface (47) via which control data including the characteristic plunger curve (K) and the at least one additional condition (Z) can be received from an external device (48) and/or transmitted to an external device (48).

8. Press (10) according to claim 1, wherein the press drive (25) further includes a third drive motor (73) which is connected to the plunger (21) via the drive unit (33) which includes a third eccentric (55) connected to the third drive motor (73).

9. Press (10) according to claim 8, wherein the third drive motor (73) is controlled by the control arrangement (28) in such a way that a tilt tendency of the plunger (21) by a non-symmetric plunger force (F) is at least partially compensated for.

10. Method for operating a press (10), the press (10) comprising:

a plunger (21) which is movable by a press drive (25) in a stroke direction H;

wherein the press drive (25) includes a first drive motor (26) and a second drive motor (27) which are connected to the plunger (21) via a drive unit (33);

wherein the drive unit (33) includes a first eccentric (34) connected to the first drive motor (26) and a second eccentric (36) connected to the second drive motor (27);

wherein the first eccentric (34) is operatively connected to main connecting rod (35) and the second eccentric (36) is operatively connected to a control connecting rod (37);

wherein drive unit (33) further comprises a multi-arm lever (38) operatively connected via a first pivot bearing (39) to the main connecting rod (35) and via a second pivot bearing (40) to the control connecting rod (37) and via a third pivot bearing (41) to the plunger (21);

a control arrangement (28) for controlling at least the first drive motor (26) and the second drive motor (27) for moving the plunger (21) and applying a plunger force thereto in accordance with a predetermined characteristic plunger curve (K);

wherein the two drive motors (26, 27) are controlled in accordance with the characteristic plunger curve (K) in such a way that at least one additional condition (Z) which is independent of a change of plunger position (P) as predetermined by the characteristic plunger curve (K) and/or the plunger force (F) is fulfilled; and, wherein each of the first pivot bearing (39) and the second pivot bearing (40) and the third pivot bearing (41) include in each case two drive components (G1, G2) supported to be movable relative to each other and wherein a first additional condition of the at least one additional condition (Z) is fulfilled when the two drive components (G1, G2) in each of the first pivot bearing (39) and the second pivot bearing (40) and the third pivot bearing (41) have a predetermined relative movement between the two drive components (G1, G2) for maintaining a predetermined minimum thickness of a lubricant film therebetween independent of whether the plunger (21) changes the plunger position (P) or whether the plunger (21) is moving or is stopped, said method comprising the following steps:

providing a change in the plunger position (P) and/or the plunger force (F) directive via the characteristic plunger curve (K);

providing the at least one additional condition (Z) which is independent of the change in the plunger position (P) and/or the plunger force (F) provided by the characteristic plunger curve (K);

operating the first drive motor (26) and the second drive motor (27) in such a way that the change in the plunger position (P) and/or the plunger force (F) corresponds to the characteristic plunger curve (K) and, additionally the first additional condition of the at least one additional condition (Z) is fulfilled.

11. Press (10) according to claim 1, wherein the predetermined minimum lubricant film thickness between the two drive components (G1, G2) exceeds that of any dirt particles contained in the lubricant film.

* * * * *